United States Patent [19]

Hofmann et al.

[11] Patent Number: 4,677,411

[45] Date of Patent: Jun. 30, 1987

[54] EXPLOSION-PROOF OR FLAME-PROOF PLUG HAVING A TRANSFORMER DISPOSED IN A COMPRESSION-RESISTANT CHAMBER

[75] Inventors: Heinz Hofmann, Eberbach; Gerhard Schwarz, Schoenbrunn-Altemuehl, both of Fed. Rep. of Germany

[73] Assignee: Brown, Boveri & Cie AG, Mannheim, Fed. Rep. of Germany

[21] Appl. No.: 722,794

[22] Filed: Apr. 12, 1985

[30] Foreign Application Priority Data

Apr. 12, 1984 [DE] Fed. Rep. of Germany ..... 3413809

[51] Int. Cl.[4] ..... H01F 27/02

[52] U.S. Cl. ..... 336/90; 310/88; 336/92; 336/96; 336/107

[58] Field of Search ..... 336/90, 92, 96, 105, 336/107; 310/88

[56] References Cited

U.S. PATENT DOCUMENTS 2,875,419 2/1959 Lear, Sr. ..... 336/96 X
3,201,729 8/1965 Blanchi et al. ..... 336/96 X
3,211,959 10/1965 Kirk ..... 336/96 X
3,259,861 7/1966 Walker ..... 336/96 X
4,024,484 5/1977 Tomczak et al. ..... 336/96 X

*Primary Examiner*—Thomas J. Kozma
*Attorney, Agent, or Firm*—Herbert L. Lerner; Laurence A. Greenberg

[57] ABSTRACT

An explosion-proof plug includes a first casing part having two ends and an outer wall having an edge and defining a compression-resistant annular chamber being open toward one of the ends, an annular transformer disposed in the annular chamber, a cover secured to the first casing part covering the annular chamber and the transformer, a second substantially bowl-shaped casing part adjacent the edge of the outer wall, the second casing part and the cover together defining a first connection space with increased security as compared to other portions of the plug for receiving connecting cables to be connected to the transformer, a third casing part securely connected to the first casing part defining a second space of increased security, and plug pins being held in the third casing part and connected to the transformer.

4 Claims, 2 Drawing Figures

Figure 1:
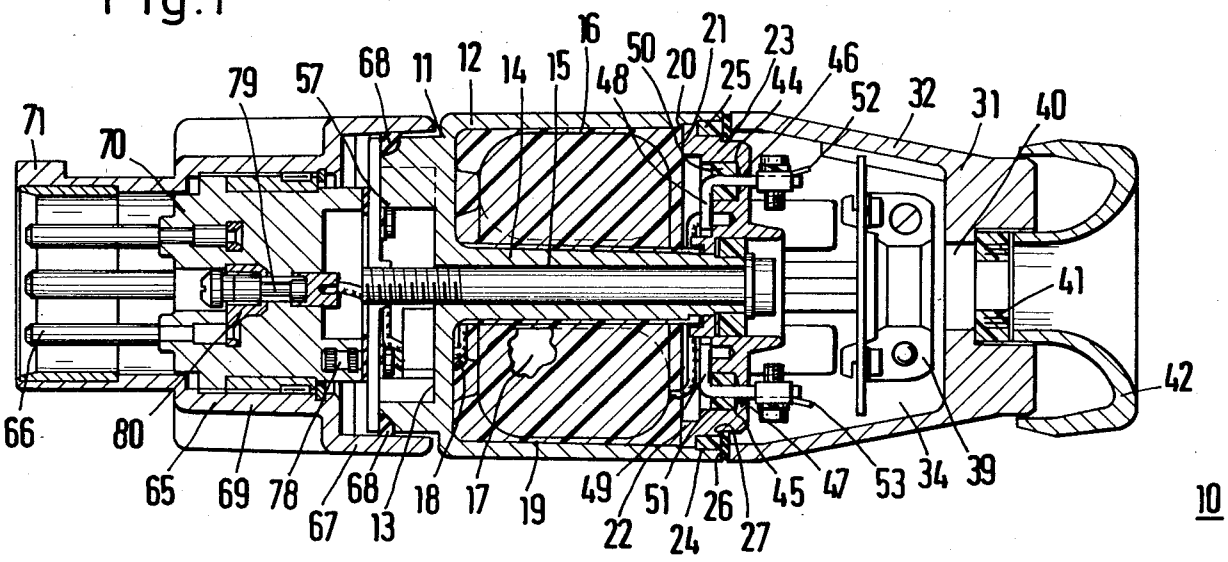

EXPLOSION-PROOF OR FLAME-PROOF PLUG HAVING A TRANSFORMER DISPOSED IN A COMPRESSION-RESISTANT CHAMBER

The invention relates to an explosion-proof or flame-proof plug, including a transformer or transformer plug disposed in a compression-resistant chamber, a space of increased security into which a connection cable is introduced and is connected therein to connection contacts connected to the transformer, and plug pins connected to the transformer.

Transformer plugs of this type are known. However, the compression resistant chamber thereof is difficult to produce when using a restricted space.

It is accordingly an object of the invention to provide an explosion-proof or flame-proof plug having a transformer disposed in a compression-resistant chamber, which overcomes the hereinafore-mentioned disadvantages of the heretofore-known devices of this general type, and which has a compression-resistant chamber which is easier to produce, without an increase in space being necessary.

With the foregoing and other objects in view there is provided, in accordance with the invention, an explosion-proof plug, comprising a first casing part having two ends and an outer wall having an edge and defining a compression-resistant annular chamber being open toward one of the ends, an annular transformer or transformer plug disposed in the annular chamber, a cover secured to the first casing part covering the annular chamber and the transformer, a second substantially cup or bowl-shaped casing part adjacent the edge of the outer wall, the second casing part and the cover together defining a first connection space with increased security as compared to other portions of the plug for receiving connecting cables to be connected to the transformer, a third casing part securely connected to the first casing part defining a second space of increased security, and plug pins being held in the third casing part at an end opposite the first connection space and the plug pins being connected to the transformer.

In accordance with an additional feature of the invention, the outer wall has an inner surface spaced from the cover defining an air gap therebetween, and including casting resin filling the air gap forming another compression-resistant chamber in the air gap.

In accordance with an added feature of the invention, the cover is substantially cup or bowl-shaped and has a rim and a side facing the compression-resistant chamber, the side having depressions formed therein inside the rim and the cover having openings formed therein communicating with the depressions, and including conductors connected to the transformer and passing through the openings, and casting resin filling the depressions.

In accordance with a concomitant feature of the invention, the first casing part has a depression formed therein at the other of the ends thereof remote from said chamber, and including terminal leads connected to the transformer and passing through the depression, and casting resin filling the depression.

The advantages achieved by the invention are in particular that the transformer plug can be produced in a simple manner and, in particular, a compression-resistant chamber can be produced in a very simple manner, structurally. Since the transformer plug essentially includes three basic casing components, it is very easy to assemble.

Other features which are considered as characteristic for the invention are set forth in the appended claims.

Although the invention is illustrated and described herein as embodied in an explosion-proof or flame-proof plug having a transformer disposed in a compression-resistant chamber, it is nevertheless not intended to be limited to the details shown, since various modifications and structural changes may be made therein without departing from the spirit of the invention and within the scope and range of equivalents of the claims.

Figure 2:
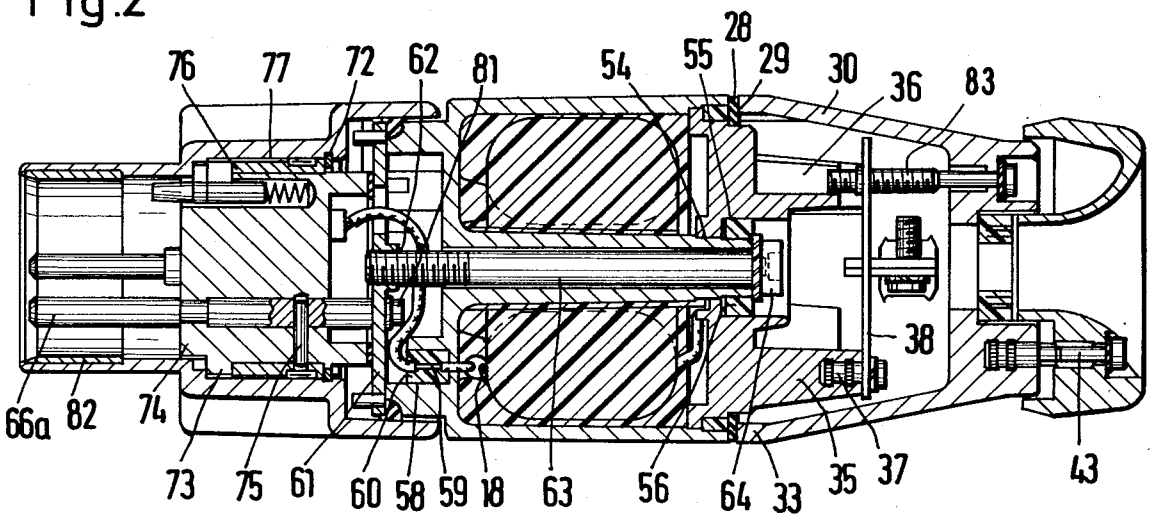

The construction and method of operation of the invention, however, together with additional objects and advantages thereof will be best understood from the following description of specific embodiments when read in connection with the accompanying drawings, in which:

FIGS. 1 and 2 are longitudinal-sectional views of a transformer plug according to the invention, which are rotated through 90° relative to each other.

Referring now to the figures of the drawings in detail and first particularly to FIG. 1 thereof, there is seen a transformer plug, which is designated with reference numeral 10 as a whole, and which includes a first casing part 11 having an outer wall 12, a base portion 13 and an extension 14 which is disposed on the base portion 13 and is oriented concentrically with the outer wall 12 in the same direction as the outer wall 12. A through bore 15 passes through the extension 14. The outer wall 12, the base portion 13 and the extension 14 together define an annular space 16 which is open towards the right. A transformer 17 is inserted into the annular space 16, in such a manner that terminals 18 disposed at the left pass through the base portion 13 in a compression-resistant manner. The entire annular space 16, in which the transformer 17 is disposed, is then filled with casting resin 19 to the extent that the transformer 17 is completely covered with casting resin.

A stepped shoulder 20 is formed on the inside of the outer wall 12, and an outer edge 21 of a cover 22 is secured against the shoulder. This cover 22 is bowl-shaped and the outer edge 21 is formed on a radially outwardly directed free end of a rim 23 of the bowl. The outer surface of the rim 23 of the bowl 22 forms an annular gap 24 together with the outer wall 12 which is filled with casting resin 25. An edge surface 29 of a second casing part 30 is secured to a seal 28 seen in FIG. 2. The seal 28 is disposed on the free surface of the casting resin 25, on a free edge surface 26 of the outer wall 12 and on a shoulder 27 formed on the outer surface of the rim of the bowl. The second casing part 30 is likewise produced in the shape of a cup, with a base portion 31 and a casing wall 32 which is integrally formed thereon and increases in a frustoconical manner and which has an end passing into an area 33 which is cylindrical. The wall 32 defines a space 34 of increased security.

Projections 35 and 36 are formed on the cover 22 on the side remote from the compression-resistant chamber. A fastening screw 37 is inserted into the free end of the projection 35 which is why the projection 35 is shown as solid material. However, the projection 36 has a cutout formed therein as shown, so that a bolt 83 passing through the plate 38 may move in the cutout. A mounting plate 38 on which a strain or traction reliever 39 for a connection cable is integrally formed or secured, is secured to the screw 37. The base portion of the second casing part 30 has a through bore 40 formed therein, in which a trumpet-like lead-in tube 42 is secured with the interposition of a seal 41. Specifically, a fastening screw 43 is inserted in the base portion 31 in a similar manner to the fastening screw 37.

The cover 22 contains two diametrically opposite depressions 44 and 45 which are open towards the compression-resistant chamber. The depressions are in communication with openings 46 and 47 through which connection lines 48 and 49 pass, so that the depressions 44 and 45 are filled with casting resin 50 and 51. A compression-resistant passage is produced in each of these areas, due to the filling with the casting resin 50 and 51. The connection lines 48 and 49 are provided at their outer ends with terminal clamps 52 and 53.

The inner region of the cover 22 contains a through bore 54 through which the extension 14 projects. The cover has an annular enlargement 55 on the outside, adjacent the bore 54. An annular space is formed by the outer wall of the extension 14 and the opening or enlargement 55, which is filled with casting resin 56 in order to seal the gap between the extension 14 and the bore 54. The compression-resistant chamber, which is formed by the annular space 16, is thus closed off on the side of the cover by casting resin fillings 25, 50, 51 and 56.

An annular rim 57 is formed on the side of the base portion 13 opposite the annular space 16. The external diameter of the rim 57 is reduced with respect to the external diameter of the outer wall 12. A depression 58 is formed on the base portion 13 in the interior of the annular rim 57. The connection or terminal lead 18 passes through the depression 58 and has an insulated area 59 in the depression. The insulated area 59 is entirely filled with casting resin 60, so as to form a compression-resistant passage of the connection lead 18 for the transformer.

A support cover 61 which is not shown in great detail, has a central area which contains a passage 62 having an internal thread on the inside thereof, so that the cover is screwed onto the end face of the annular rim 57. A screw bolt 63 traversing the bore 15 passes through this passage 62: the screw bolt is securely clamped on the first casing part by means of the support cover or support plate 61 and by means of a nut 64.

A third casing part 65, which receives plug pins 66, is connected to the second casing part 11. The third casing part 65 includes a first area 67 which embraces the annular rim 57 with the interposition of a seal 68, and a second area 69 with a smaller cross section, which surrounds a plug holding member 70, adjoins the first area 67. A third area in the form of collar 71 embracing the plug pins 66 is then joined to the second area. In vicinity of the left-hand end of the plug holding member 70, and the outer periphery thereof, the member 70 has a flange-like annular projection 73. The projection 73 bears at one end against a stop 74 on the third casing part 65, approximately in the region of the transition from the second to the third area 71. A metal sleeve 76, secured by a pin 75, has one end which bears on the other end of the annular projection 73 and another end which bears against a guard ring 72 inserted into the inner surface of the second area 69. In this way, the plug holding member 70 is secured in the interior of the third casing part 65. The metal sleeve 76 together with the inner surface of the second area 69 and the plug holding member 70, defines one air gap 77 in each case, the length and width of which must comply with the provisions set forth by certain agencies, such as the Association of German Electrical Engineers.

Screw bolts 78, through which the mounting plate 61 is securely screwed to the plug holding member 70, are inserted in the plug holding member 70 on the side opposite the plug pins.

The individual plug pins 66 are inserted in the plug holding member, such as by being injected or cast during the manufacture of the plug holding member.

A fuse 79 is disposed in the center of the plug holding member 70. One end of one of the connection or terminal leads 18 is connected to the transformer. One plug pin 66, which is shown in the lower part of FIG. 1, is connected to the fuse 79 by means of an intermediate part 80 inserted into the plug holding member 70. A plug pin **66*a* which has an external diameter that is greater than that of the other plug pins, is a so-called grounding pin; the pin 75, which secures the metal sleeve 76 is inserted into the plug pin 66*a*, as a result of which the metal sleeve 76 is connected in an electrically conductive manner to the plug pin 66*a*. The plug pin 66*a* is connected by means of a screw connection 81 to the support plate 61 and by means of the screw bolt 63 to all of the metal parts of the transformer plug 10** and thus to ground.

A metal sleeve 82 is inserted in the interior of the collar 71. The sleeve 82 forms an air gap together with a mating member on an insertion socket, in which transformer plugs, according to FIGS. 1 and 2 can be inserted. The air gap has a length and a width in accordance with the provisions of the applicable agency, such as the Association of German Electrical Engineers.

The space between the base portion 13 and the plug holding member 70 is in the form of a space having increased security. In particular, the seal 68 makes a contribution toward this security.

The assembly of the transformer plug 10 is carried out as follows:

First of all, the plug holding member 70 together with the metal sleeve 76 pressed or cast therein is inserted into the third casing part 65 and fixed therein by means of the guard ring 72. The support plate 61 is securely connected to the plug holding member 70 by means by the screw-nut connections 78 and 81.

The transformer is then inserted into the annular space, the connection or terminal leads 18 being passed through the depression 58. The annular space and the depression 58 are filled with casting resin. At the same time, the depressions 44, 45, through which the connection leads 48 and 49 project, are filled and after the electrical terminals to the transformer have been formed, the cover 22 is placed in position and the gaps 24 and 56 are filled with casting resin. The first casing part 11 together with the second casing part 30 is then connected to the support plate 61 by means of the screw bolt 63 in such a way that the first casing part comes to bear with the annular rim 57 against the support plate 61. The mounting plate 38 is then positioned on the second casing part 30 and secured thereto, and the outer connections which are not shown can then be securely clamped to the connecting terminals 52 and 53, the subsequent assembly of the second casing part 30 already having been taken into account. The second casing part 30 is then securely connected to the mounting plate 38 by means of a screw connection, and with the interposition of a seal 28 between the two edge surfaces of the first and second casing parts to be positioned facing one another. After the trumpet-shaped lead-in tube has been secured to the second casing part by means of the screw-nut connections 43, the transformer plug 10 is ready.

We claim:

1. Explosion-proof plug, comprising a first cylindrical casing part having an outer wall with two ends, a base portion, an inner hollow cylindrical member and an edge formed on one of said ends of said outer wall, said outer wall, said base portion and said inner member defining an annular chamber withstanding compression caused by sparks ignited therein, said annular chamber being open toward one of said ends, an annular transformer disposed in said annular chamber, a cover covering said annular chamber and said transformer, a screw bolt attached to said cover and extended through said inner member securing said cover to said first casing part, a second substantially cup-shaped casing part adjacent said edge of said outer wall at said one end of said first casing part, said second casing part and said cover together defining a first connection space, terminal clamps disposed in said first connection space and connected to said transformer for receiving connecting cables to be connected to said transformer, a third casing part securely connected to said first casing part defining a second space at the other of said ends of said first casing part opposite said one end, terminal leads disposed in said second space, and plug pins being held in said third casing part and connected to said transformer through said terminals, said casing parts and said cover providing increased security in said first and second spaces as compared to other portions of the plug by preventing sparks inside said first and second spaces from reaching an explosive atmosphere possibly existing outside the plug.

2. Explosion-proof plug according to claim 1, wherein said outer wall has an inner surface spaced from said cover defining an air gap therebetween, and including casting resin filling said air gap forming and sealing said compression-resistant chamber.

3. Explosion-proof plug according to claim 1, wherein said cover is substantially cup-shaped and has a rim and a side facing said compression-resistant chamber, said side having depressions formed therein inside said rim and said cover having openings formed therein communicating with said depressions, and including conductors connected to said transformer and passing through said openings, and casting resin filling said depressions.

4. Explosion-proof plug according to claim 1, wherein said first casing part has a depression formed therein at the other of said ends thereof, said terminal leads connected to said transformer passing through said depression, and including casting resin filling said depression.

* * * * *